US005794693A

United States Patent [19]

Wright et al.

[11] Patent Number: 5,794,693

[45] Date of Patent: Aug. 18, 1998

[54] DUAL TUBING STRING HANGING APPARATUS

[75] Inventors: Andrew Wright, Sherwood Park; Curtis Phillip Ring, Okotoks, both of Canada

[73] Assignee: Alberta Basic Industries Ltd., Calgary

[21] Appl. No.: 641,761

[22] Filed: May 2, 1996

[51] Int. Cl.[6] ..... E21B 33/047

[52] U.S. Cl. ..... 166/85.5; 166/75.14; 166/78.1; 166/97.5

[58] Field of Search ..... 166/85.5, 89.2, 166/97.5, 75.14, 78.1

[56] References Cited

U.S. PATENT DOCUMENTS

| | | | |
|---|---|---|---|
| 1,662,984 | 3/1928 | Scott et al. . | |
| 2,694,450 | 11/1954 | Osbun | 166/75.14 |
| 2,696,261 | 12/1954 | Ennis | 166/75.14 |
| 2,788,073 | 4/1957 | Brown | 166/78.1 |
| 2,830,665 | 4/1958 | Burns et al. | 166/97.5 |
| 2,846,013 | 8/1958 | Davis | 166/97.5 |
| 3,007,719 | 11/1961 | Sherman et al. | 166/97.5 |
| 3,247,903 | 4/1966 | Knight | 166/89.2 |
| 3,299,958 | 1/1967 | Todd | 166/97.5 |
| 5,465,788 | 11/1995 | Wright | 166/78.1 |

FOREIGN PATENT DOCUMENTS 2137336 6/1996 Canada .

*Primary Examiner*—Hoang C. Dang
*Attorney, Agent, or Firm*—Merek & Voorhees

[57] ABSTRACT

An apparatus for hanging a production tubing string and a guide string within a well casing having a wellhead. The apparatus includes a primary hanger shell for supporting the production tubing string and guide string in the well casing, a production mandrel received within the primary hanger shell and connected to the production tubing string to hang the production tubing string within the primary hanger shell, and a guide string hanger connected to and hanging the guide string within the primary hanger shell. The guide string hanger also allows the guide string to be removed from the well casing independently from the removal of the primary hanger shell, the production mandrel or the production tubing string.

27 Claims, 3 Drawing Sheets

DUAL TUBING STRING HANGING APPARATUS

FIELD OF THE INVENTION

This invention relates to an apparatus for hanging a production tubing string and a guide string within a well casing, such as is commonly used in the oil production industry.

BACKGROUND OF THE INVENTION

Many production oil wells are "dual string" wells, meaning that they include both a production tubing string and a guide string located within the well casing. The production tubing string serves to contain the pump or sucker rod and provides a means to extract oil. The string is often rotated through a variety of different means or methods in order to more evenly distribute wear on its inside surface due to contact with the pump rod.

The primary purpose of a guide string in a dual string well configuration is to allow for the insertion of a flushing tube into the well casing so that "clean-out" fluids or steam can be injected into the well to stir-up or dislodge sediment in situations of plugged or low producing wells. That is, it is often the case, particulary in sandy wells, that sand and/or other types of sediments accumulate at or near the downhole pump and either plug the well or significantly reduce its production capacity. The utilization of a guide string, that enables the insertion of a flushing tube through which clean-out fluid can be injected, is therefore extremely valuable for re-activating plugged wells or increasing the productivity of wells that are partially plugged or filled with sand or sediment. Since the guide string does not encase a constantly moving pump or sucker rod, the guide string is not subjected to the same level of friction and wear as in the case of the production string and hence there is no need for rotation of the guide string. Although such dual string wells have proven to be effective in many cases, the use of currently known methods of configuring a dual string well often result in production difficulties. For example, existing dual string hangers, or rotating mechanisms from which both the production string and guide string are supported, tend to be heavy, awkward and are screwed or connected directly to both the production and guide strings. Accordingly, when it becomes necessary to remove either the rotator, the guide string, or the production tubing string, all three structures must be simultaneously removed from the well casing. Due to the size and weight of these components, this task is usually time and labour intensive, requires the utilization of heavy lifting equipment, and is very costly. Furthermore, existing dual string rotators or hanging devices have no means for well control during installation or removal. That is, such devices do not incorporate mechanisms to control gas bubbles or oil which may be forced up the inside of the well casing and can result in an oil spill or possible blow out.

SUMMARY OF THE INVENTION

The invention therefore provides a dual string tubing hanger which overcomes the short comings of these prior devices through the incorporation of a structure providing for a means to hang both a production tubing string and a guide string within a well casing while allowing the guide string to be removed independently from the production tubing string. The dual string hanging device of the present invention also provides a means to help ensure full well control to prevent accidental oil spills or blow outs.

Accordingly, in one of its aspects, the invention provides an apparatus for hanging a production tubing string and a guide string within a well casing having a wellhead, the apparatus comprising: a primary hanger shell for supporting said production tubing string and said guide string in said well casing; a production mandrel received within said primary hanger shell, said production mandrel connected to said production tubing string and hanging said production tubing string within said primary hanger shell; and, guide string hanging means connected to and hanging said stationary guide string within said primary hanger shell, said guide string hanging means allowing said guide string to be removed from said well casing independently from the removal of said primary hanger shell, said production mandrel or said production tubing string.

In another aspect, the present invention provides an apparatus for hanging a production tubing string and a guide string within a well casing having a wellhead, the apparatus comprising: a primary hanger shell for supporting said production tubing string and said guide string within said well casing; a production mandrel received within said primary hanger shell, said production mandrel having lower engagement means for connection to said production tubing string; guide string hanging means connected to and hanging said guide string from said primary hanger shell; and, guide means for receiving and directing a flushing tube into said guide string, said guide means including a tapered bore to receive and facilitate the insertion of said flushing tube into said guide string while reducing kinking and damaging of said flushing tube.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
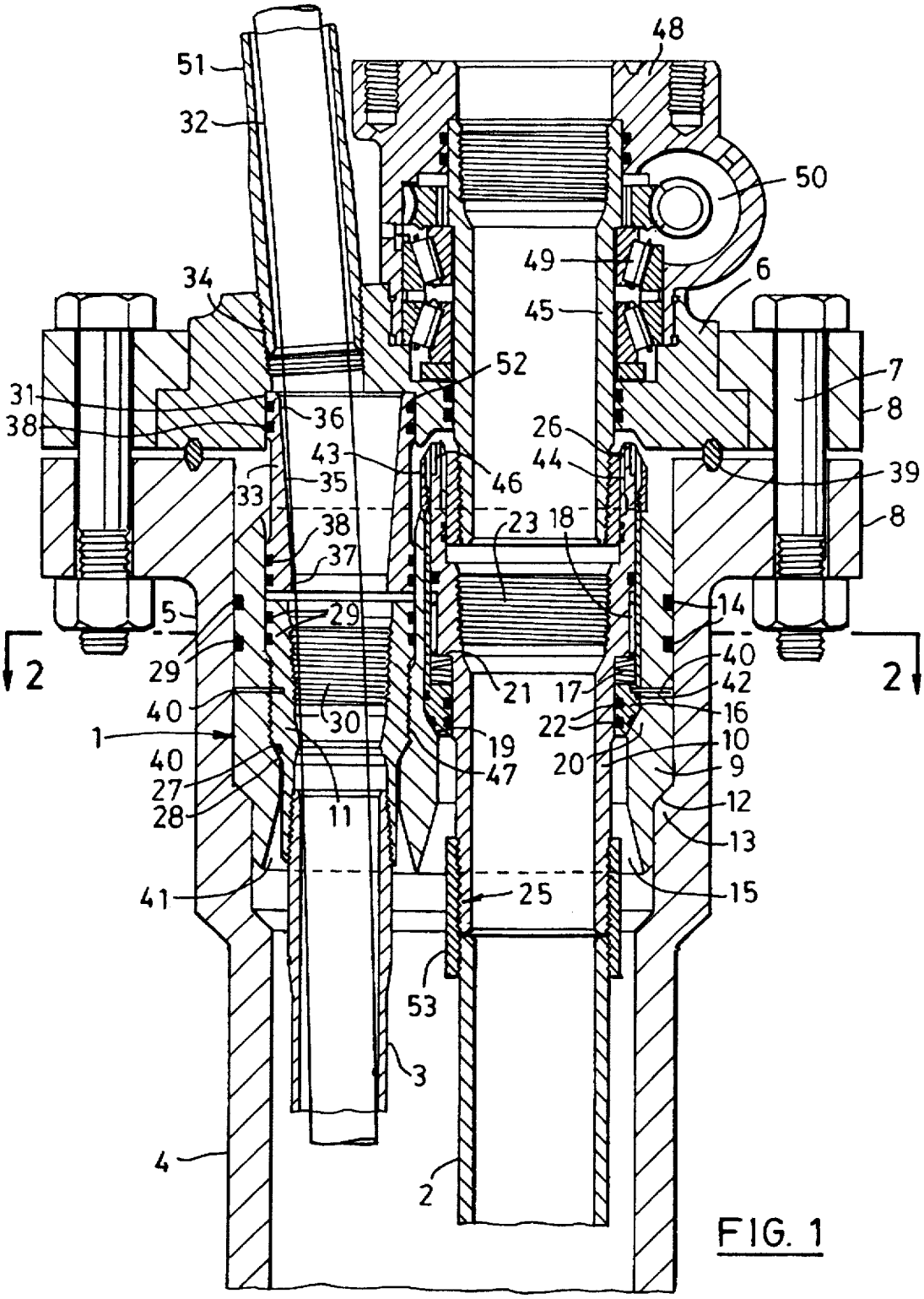
FIG. 1 is a side elevational view in longitudinal section of the dual tubing string hanging apparatus in accordance with the present invention.

Referring to FIG. 1, the dual tubing string hanging apparatus pursuant to the present invention is generally noted by the numeral 1. Device 1 is used to hang a production tubing string 2 and a guide string 3 within a well casing 4 having a wellhead 5. Where frictional contact between the pump rod and production tubing string 2 is significant, a rotator head 6 will be mounted on wellhead 5. Rotator head 6 is comprised generally of a housing 48, a rotator shaft 45, bearing means 49 and drive means 50. Typically a pair of opposing flanges 8, situated on well head 5 and rotator head 6, are held together though the use of bolts 7 to securely attach rotator head 6 to well head 5. A seal 39 is positioned between flanges 8.

Figure 2:
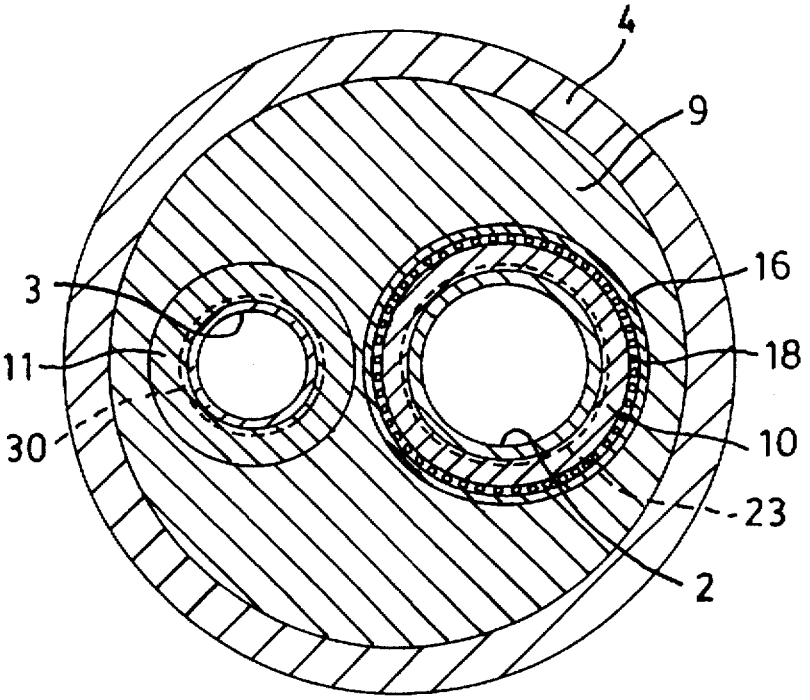
FIG. 2 is a sectional view of the device in FIG. 1 taken along the line 2—2; and, FIG. 3 is an enlarged detailed view of the dual tubing string hanging apparatus as shown in FIG. 1.
Figure 3:
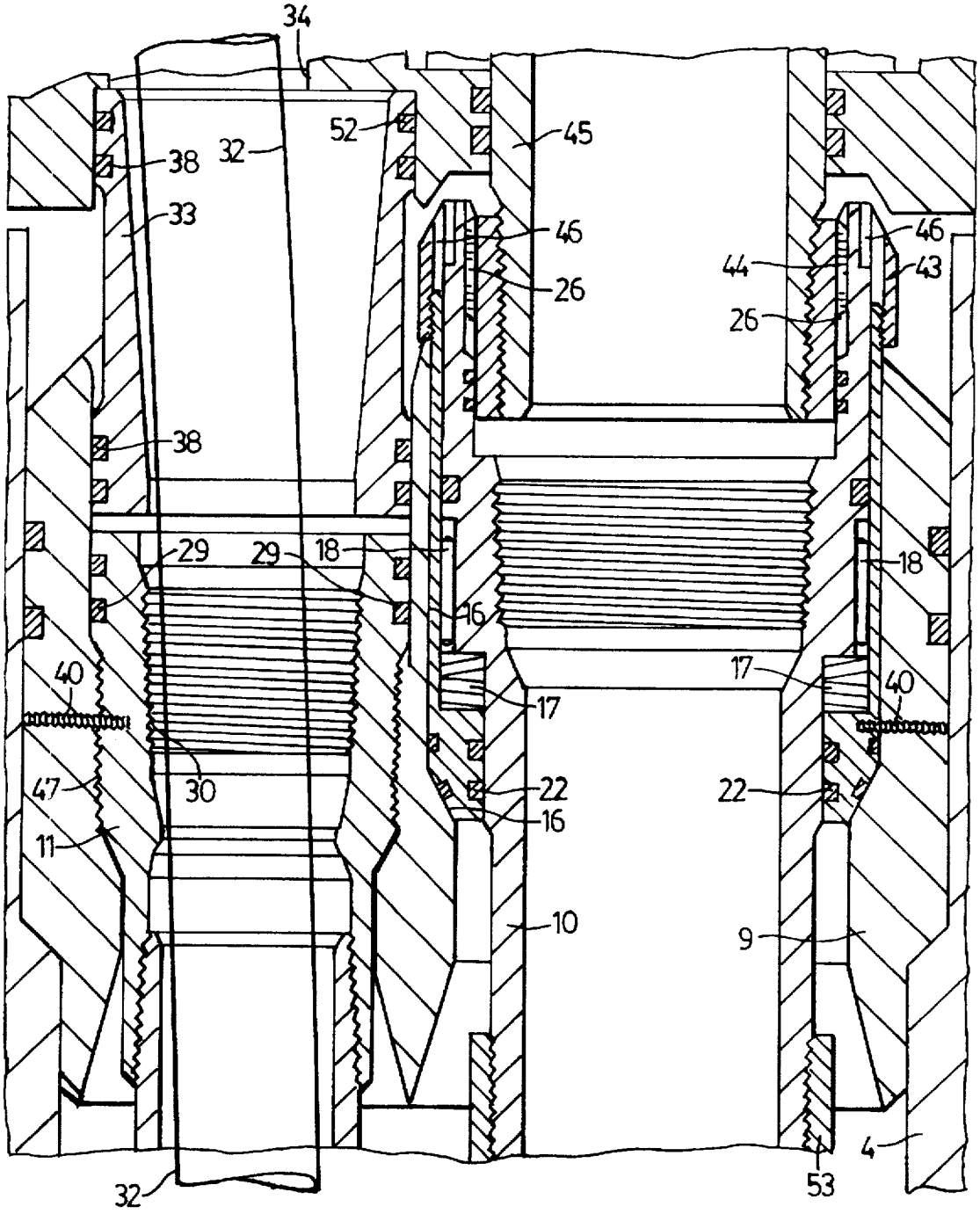

Dual tubing string hanging apparatus 1 is comprised generally of a primary hanger shell 9, a production mandrel 10 and guide string hanging means 11. As shown in FIGS. 1 and 2, primary hanger shell 9 is of a generally cylindrical shape in order to closely fit within the inside circumference of well casing 4. A circumferential inward taper 12 on the bottom of primary hanger shell 9 engages an inwardly sloping shoulder 13 in well casing 4 such that primary hanger shell 9 rests against shoulder 13 and is supported thereon in the nature of a "plug" or "wedge".

It will be appreciated that this "plug" or "wedge" nature of primary hanger shell 9 will result in a very close fit between primary hanger shell 9 and well casing 4, particularly as primary hanger shell 9 is machined to closely match the internal diameter of well casing 4. Furthermore, it will also be appreciated that the weight of production tubing string 2 and guide string 3 suspended from primary hanger shell 9 will tend to wedge primary hanger shell 9 further into shoulder 13 of well casing 4, thereby increasing the effective seating between the respective parts. The wedging of primary hanger shell 9 within well casing 4 acts as a means to seal against accidental spillage or blow out of oil or gases between primary hanger shell 9 and well casing 4. As a further means to seal against accidental spillage or blow out, a series of seals 14 are inserted between primary hanger shell 9 and well casing 4.

The removal of primary hanger shell 9 from well casing 4 is accomplished with the assistance of lifting means 47. In the preferred embodiment, lifting means 47 comprises a set of lifting threads into which a pipe, puller or other tool can be threaded. Primary hanger shell 9 can then be removed from well casing 4 through the application of a lifting force that is generally parallel to well casing 4.

Primary hanger shell 9 acts much like a cork in a bottle with two longitudinal bores 15 and 41 for receiving production tubing string 2 and guide string 3. In most applications production tubing string 2 will be of a larger diameter than guide string 3. For this reason, bore 15 will normally be larger than bore 41 to accommodate the production mandrel 10. Smaller bore 41 will then accommodate the guide string.

In the preferred embodiment bore 15 also receives a secondary hanger 16. Secondary hanger 16 has a primary purpose of housing rust bearings 17 and radial bearings 18. The use of secondary hanger 16 to house bearings 17 and 18 will thus enable the bearings to be easily removed, independently from primary hanger shell 9 and guide string 3, for purposes of cleaning and maintenance. Referring again to FIG. 1, secondary hanger 16 is held within primary hanger shell 9 in a similar fashion as primary hanger shell 9 is held within well casing 4. That is, secondary hanger 16 is equipped with a circumferential inwardly tapering lower end 19 which wedges against an inwardly sloping shoulder 20 of primary hanger shell 9. Once again it will be appreciated that the downward pressure placed upon secondary hanger 16 when in operation will seat secondary hanger 16 against primary hanger shell 9. However, to further enhance this seating arrangement, a seal 42 is placed between secondary hanger 16 and primary hanger shell 9 to prevent the unwanted escape of oil or gases.

With secondary hanger shell 16 in place, production mandrel 10, assembled together bearings 17 and 18 and various associated seals, is inserted into primary hanger shell 9. An outwardly extending circumferential lip on production mandrel 10 bears against thrust bearing 17 in secondary hanger 16 such that production mandrel 10 in effect hangs from secondary hanger 16, and hence primary hanger shell 9. Thrust bearing 17 and radial bearings 18 therefore allow production mandrel 10 to freely rotate within the structure. A series of dynamic seals 22 are situated between production mandrel 10 and secondary hanger 16 to once again prevent the unwanted escape or blow-by of oil or gases.

Production tubing string 2 is connected to engagement means 25 on the bottom of production mandrel 10 such that the entire production tubing string is hung from production mandrel 10. In the preferred embodiment, engagement means 25 comprises a coupling 53 threaded onto mandrel 10 and production tubing string 2. As discussed, the weight of production tubing string 2 will thus help to enhance the seating of primary hanger shell 9 within casing 4 and will also help to seat secondary hanger 16 and production mandrel 10 within primary hanger shell 9. It will be understood that through this configuration of parts, primary hanger shell 9 provides a means for hanging production tubing string 2 within well casing 4 while also providing a means to allow for the rotation of production tubing string 2, where necessary, in order to more evenly distribute wear on its inside surface. A lifting thread 23, positioned on the internal circumferential surface of production mandrel 10, enables a lifting tool or threaded rod to be screwed into production mandrel 10 such that the mandrel, along with the entire production tubing string, can be readily and easily lifted from the well independently and separately from the removal of primary hanger shell 9 or guide string 3. In the preferred embodiment, a retainer nut 43 is screwed onto the top of secondary hanger 16 to retain production mandrel 10 within secondary hanger 16, such that removal of production mandrel 10 from primary hanger shell 9 also results in the removal of secondary hanger 16.

When it becomes necessary to remove production tubing string 2 and production mandrel 10 from the well head, as discussed, a tool or threaded rod can be screwed into lifting threads 23. However, as production mandrel 10 effectively hangs from thrust bearings 17, an attempt to screw a lifting tool into threads 23 may result in rotation of mandrel 10 and the inability to screw the tool completely into threads 23. Accordingly, when attempting to lift production mandrel 10 from the well head it may be necessary to insert a lock key or rectangular bar stock into slots 46 in production mandrel 10 and retainer nut 43. The lock key will then prevent production mandrel 10 from turning and allow a lifting tool to be readily screwed into lifting threads 23.

In order to allow for the possible connection of production mandrel 10 to rotator head 6, production mandrel 10 includes upper engagement means 26 for coupling with rotary head 6. Preferably upper engagement means 26 comprise a series of longitudinally arranged splines, which mesh with corresponding splines 44 on shaft 45 of rotator head 6, that provide a means for transferring rotational movement from rotator head 6 to production mandrel 10. Splines 44 may also be in the form of a splined coupling that is threaded onto shaft 45. Where a spline coupling is used further seals are placed between the coupling and mandrel 10.

The spline connection between shaft 45 and production mandrel 10 will permit rotator head 6 to be disengaged and removed from production mandrel 10 through the application of a lifting force in a direction generally parallel to the longitudinal axis of mandrel 10 and well casing 4. This form of engagement means between rotator head 6 and production mandrel 10 allows for the disengagement and removal of rotary head 6 without the necessity of lifting or removing production tubing string 2, guide string 3 or primary hanger shell 6.

Referring again to FIG. 1, as indicated previously primary hanger shell 9 contains two bores passing longitudinally through it. Typically the smaller diameter bore 41 is used to accommodate guide string 3. Guide string hanging means 11 may comprise a threaded portion on the lower part of bore 41 into which guide string 3 can be threaded. However, in the preferred embodiment guide string 3 is threaded onto the bottom of a separate component that forms guide string hanging means 11. That component is held within, and supported by, primary hanger shell 9. This preferred embodiment of guide string hanging means 11 will now be discussed in greater detail.

Guide string hanging means 11 is preferably a generally cylindrical shaped hanger having an inwardly tapered shoulder 27 which bears against an inwardly sloping shoulder 28 on primary hanger shell 9. The bearing of shoulder 27 against shoulder 28 supports guide string hanging means 11 within primary hanger shell 9 and effectively allows guide string 3 to be hung within well casing 4. The weight of guide string 3 bearing downwardly upon guide string hanging means 11 will tend to wedge guide string hanging means 11 into primary hanger shell 9 and will effectively seat the two parts together, thereby helping to prevent against the accidental blow-by of oil or gasses. To further reduce the possibility of accidental blow-by around guide string hanging means 11, and to help ensure full well control, a series of seals 29 are placed between guide string hanging means 11 and primary hanger shell 9.

Through the use of guide string hanging means 11, guide string 3 can be removed from well casing 4 independently from the removal of primary hanger shell 9, production mandrel 10 and production tubing string 2. That is, the structure of guide string hanging means 11 and the manner in which it is supported within primary hanger shell 9 allows for guide string 3 to be removed for replacement and servicing without the need to incur the time and expense of pulling the entire production string from the well. To facilitate the removal of guide string hanging means 11 and guide string 3, guide string hanging means 11 includes a set of guide string lifting threads 30. Lifting threads 30 accordingly allow a lifting tool or threaded rod to be screwed into guide string hanging means 11 so that guide string 3 may be pulled from the well.

Since the primary purpose of guide string 3 is to receive and allow for the insertion of a flushing tube into the well casing, device 1 also includes guide means 31 to receive and direct flushing tube 32 into guide string 3. As shown in FIG. 1, in the preferred embodiment guide means 31 comprises a guide coupling 33 and a guide tubing 51 that is received within a bore 34 through rotator head 6. If a rotator is not being used, bore 34 will simply pass through the upper flange of the wellhead. Guide coupling 33 includes a smooth internal bore 35 that is tapered such that its internal diameter decreases toward the direction of guide string 3. That is, when positioned within primary hanger shell 9 the internal bore 35 of guide coupling 33 becomes progressively smaller in a downward direction. Bore 35 is sized such that the opening at its upper end 36 is somewhat larger than the diameter of flushing tube 32 while the lower end 37 of bore 35 has a diameter that is only very slightly larger than the outside diameter of flushing tube 32. Preferably lower end 37 will have a diameter exceeding the outside diameter of flushing tube 32 by approximately 0.4 inches. Bore 35 also preferably has an inward taper of approximately 4 degrees. An inward taper of this magnitude has been found to be sufficient to allow the flushing tube to clear the rotator head or other items above the wellhead, and yet will not result in binding of the flushing tube within bore 35.

Typically flushing tube 32 is comprised of a roll of endless tubing that is slowly uncoiled and inserted into guide string 3. It has been found that the incorporation of guide coupling 33, with its smooth inwardly tapering bore, facilitates in the insertion of flushing tube 32 into guide string hanging means 11 and guide string 3 while reducing the tendency or likelihood of kinking or damaging the flushing tube. Most often flushing tubes 32 are comprised of steel or a similar alloy that cannot be bent sharply or turn sharp corners without kinking, galling, scraping or overstressing. Accordingly, as shown in FIG. 1, the inwardly tapering bore 35 of guide coupling 33 helps to funnel flushing tube 32 into guide string hanging means 11 and presents a zone of relatively low contact and pressure. This helps to bend and urge flushing tube 32 into guide string hanging means 11 and also reduces wear on flushing tube. The approximate 4 degree taper will also tend to reduce compressive yielding on the surface of the flushing tube. To further reduce wear and facilitate the insertion of flushing tube 32, guide coupling 33 is preferably comprised of bronze or a similar material. In some cases a lubricating oil may be used.

As is shown in FIG. 1, guide coupling 33 is preferably situated at the top of guide string hanging means 11 and below bore 34 and guide tubing 51. Guide tubing 51 is received in bore 34 and provides a means for flushing tube 32 to pass through rotator head 6 (or through the upper wellhead flange where no rotator is used.) With this positioning of components, guide coupling 33 is at the approximate mid-point of the curvature of flushing tube 32 as it is directed into guide string 3. The placement of guide coupling 33 at this location thus helps to further enhance its funnelling effect and ease flushing tube 32 more readily into guide string hanging means 11.

It should be noted that guide coupling 33 is releasably received within both primary hanger shell 9 and within an enlargement 52 of the lower portion of bore 34. Since guide coupling 33 is not a weight bearing member, and as none of the other component parts of device 1 are hung from guide coupling 33, it is machined so as to be a "plug-in" component that is received within the top of primary hanger shell 9 and within enlargement 52. A series of seals 38 are placed at both the upper and lower ends of guide coupling 33 to help prevent any accidental blow-by of oil or gasses and to further ensure full well control.

In order that guide string hanging means 11 and guide string 3 remain secured within primary hanger shell 9 when flushing tube 32 is extracted from the well, a series of hold down means 40 are used to lock guide string hanging means 11 within primary hanger shell 9. In the preferred embodiment hold down means 40 are comprised of a series of set screws that pass through the body of primary hanger shell 9 and into the side of guide string hanging means 11. Similarly, in order to secure secondary hanger 16 within primary hanger shell 9 such that it does not become dislodged when production mandrel 10 is lifted, a further series of set screws may be positioned such that they pass through primary hanger shell 9 and into the sides of secondary hanger 16. In this case it would not be possible to remove secondary hanger with production mandrel 10. It would also be necessary to disengage retaining nut 43 from secondary hanger 16 before lifting mandrel 10.

It will be understood that the configuration of dual tubing string hanging apparatus 1 as described above will provide a means to hang both a production tubing string and a guide string within a well casing while allowing for the independent removal of the production string and guide string. Furthermore, the "plug-in" nature of production mandrel 10 and guide coupling 33 allow for the quick and easy removal of a rotator head without the necessity of removing either the guide or production strings. The use of lifting threads on the production mandrel, guide string hanging means, and primary hanger shell facilitate in the removal of those component parts from the well casing. Finally, the structure of guide coupling 33 readily enables flushing tube 32 to be inserted into guide string 3 without suffering the deleterious effects commonly experienced in prior art devices.

It is to be understood that what has been described are the preferred embodiments of the invention and that it may be possible to make variations to these embodiments while staying within the broad scope of the invention. Some of these variations have been discussed while others will be readily apparent to those skilled in the art. For example, while a secondary hanger 16 containing thrust bearings 17 and radial bearings 18 has been described and shown in the drawings it would be possible to mount thrust bearings 17 and radial bearings 18 directly within primary hanger shell 9. The servicing and maintenance of the bearings would be more difficult, however, production mandrel 10 would function much in the same manner. Furthermore, while use of a particular guide coupling 33 has been described, it will be readily understood by those in the art that an offset bore or tilted or angled coupling could also be utilized.

We claim:

1. An apparatus for hanging a production tubing string and a guide string within a well casing having a wellhead, the apparatus comprising:

(i) a primary hanger shell for supporting said production tubing string and said guide string in said well casing;

(ii) a production mandrel rotatable received within said primary hanger shell, said production mandrel connected to said production tubing string and rotationally hanging said production tubing string within said primary hanger shell such that rotation of said production mandrel causes rotation of the production tubing string; and, (iii) guide string hanging means connected to and hanging said guide string within said primary hanger shell, said guide string hanging means allowing said guide string to be removed from said well casing independently from the removal of said primary hanger shell, said production mandrel or said production tubing string.

2. An apparatus as claimed in claim 1 including guide means for receiving and directing a flushing tube into said guide string.

3. An apparatus as claimed in claim 2 wherein said guide string hanging means includes a set of guide string lifting threads to allow said guide string hanging means and said guide string to be independently lifted and removed from said primary hanger shell and said well casing.

4. An apparatus as claimed in claim 3 wherein said guide means comprises a guide coupling receivable within said primary hanger shell.

5. An apparatus as claimed in claim 4 wherein said guide coupling includes an internal bore that is tapered such that its internal diameter decreases in the direction of said guide string, said tapered internal bore facilitating in the insertion of said flushing tube into said guide string hanging means and said guide string while reducing kinking and damaging of said flushing tube.

6. An apparatus as claimed in claim 5 wherein said production mandrel includes bearing means and said wellhead has a rotator head mounted thereon, said rotator head providing a means to rotate said production mandrel.

7. An apparatus as claimed in claim 6 wherein said production mandrel includes engagement means allowing for the engagement of a rotator head on said wellhead, said engagement means also allowing for the disengagement of said rotator head from said wellhead, independently from the removal of said production mandrel, said guide means, or said primary hanger shell, through the application of a lifting force in a direction generally parallel to the longitudinal axis of said well casing.

8. An apparatus as claimed in claim 7 wherein said production mandrel includes bearing means and said wellhead has a rotator head mounted thereon, said guide means comprising a bore drilled through said rotator head.

9. An apparatus as claimed in claim 8 wherein said primary hanger shell includes lifting means to facilitate the removal of said primary hanger shell from said well casing.

10. An apparatus as claimed in claim 9 wherein said lifting means comprises a set of lifting threads on said primary hanger shell such that said primary hanger shell can be removed from said well casing through the application of lifting force generally parallel to said well casing.

11. An apparatus as claimed in claim 10 including hold down means to secure said guide string hanging means within said primary hanger shell.

12. An apparatus as claimed in claim 11 wherein said guide string hanging means is threaded onto said guide string.

13. An apparatus as claimed in claim 12 including sealing means to prevent the accidental escape of the contents of said well casing past said primary hanger shell.

14. An apparatus as claimed in claim 13 wherein said sealing means comprises a series of seals that are positioned between said primary hanger shell and said well casing, between said primary hanger shell and said production mandrel, and between said primary hanger shell and said guide string hanging means.

15. An apparatus as claimed in claim 14 wherein said hold down means are set screws.

16. An apparatus as claimed in claim 15 wherein the walls of said internal bore of said guide coupling are tapered inwardly at an angle of approximately 4 degrees.

17. An apparatus for hanging a production tubing string and a guide string within a well casing having a wellhead, the apparatus comprising:

(i) a primary hanger shell for supporting said production tubing string and said guide string within said well casing;

(ii) a production mandrel received within said primary hanger shell, said production mandrel having lower engagement means for connection to said production tubing string;

(iii) guide string hanging means connected to and hanging said guide string from said primary hanger shell; and, (iv) guide means for receiving and directing a flushing tube into said guide string, said guide means including a tapered bore to receive and facilitate the insertion of said flushing tube into said guide string while reducing kinking and damaging of said flushing tube.

18. An apparatus as claimed in claim 17 wherein said production mandrel includes bearing means and said wellhead has a rotator head mounted thereon, said guide means comprising a bore drilled through said rotator head.

19. An apparatus as claimed in claim 17 wherein said guide means comprises a guide coupling releasably received within said primary hanger shell.

20. An apparatus as claimed in claim 19 wherein said wellhead has a rotator head mounted thereon, said rotator head providing a means to rotate said production mandrel.

21. An apparatus as claimed in claim 20 wherein said production mandrel includes upper engagement means to couple said production mandrel to said rotator head mounted on said wellhead, said upper engagement means allowing for the disengagement of said rotator head from said production mandrel through the application of lifting force in a direction generally parallel to the longitudinal axis of said well casing.

22. An apparatus as claimed in claim 21 including a secondary hanger received in and supported by said primary hanger shell, said secondary hanger including at least one set of thrust bearings and receiving and supporting said production mandrel therein.

23. An apparatus as claimed in claim 22 wherein said bore of said guide coupling tapers inwardly at an angle of approximately 4 degrees.

24. An apparatus as claimed in claim 23 wherein said guide string hanging means is a generally cylindrical shaped hanger.

25. An apparatus as claimed in claim 24 wherein said guide string hanging means includes a set of guide string lifting threads to allow said guide string hanging means and said guide string to be independently removed from said well casing.

26. An apparatus as claimed in claim 25 including a series of set screws to secure said guide string hanging means and said secondary hanger within said primary hanger shell.

27. An apparatus as claimed in claim 17 wherein said guide string hanging means comprises a set of threads on said primary hanger shell, said guide string threadably received into said threads.

* * * * *